US006442856B1

(12) United States Patent
Warner

(10) Patent No.: US 6,442,856 B1
(45) Date of Patent: Sep. 3, 2002

(54) EXTENDABLE TOOL FOR USE MARKING ANGULAR LINES

(75) Inventor: Robert L. Warner, Royse City, TX (US)

(73) Assignees: Genuity Inc., Burlington, MA (US); Verizon Corporate Services Group Inc., New York, NY (US)

( * ) Notice: Subject to any disclaimer, the term of this patent is extended or adjusted under 35 U.S.C. 154(b) by 0 days.

(21) Appl. No.: 09/544,628

(22) Filed: Apr. 6, 2000

(51) Int. Cl.[7] ..... B43L 7/027

(52) U.S. Cl. ..... 33/478; 33/429; 33/474

(58) Field of Search ..... 33/478, 405, 427, 33/428, 429, 452, 453, 464, 465, 471, 472, 473, 474, 475, 476, 482

(56) References Cited

U.S. PATENT DOCUMENTS

| | | | | | |
|---|---|---|---|---|---|
| 909,023 | A | * | 1/1909 | Ratner | 33/478 |
| 2,507,460 | A | * | 5/1950 | Schacht | 33/453 |
| 2,704,890 | A | * | 3/1955 | Welsch | 33/DIG. 1 |
| 2,973,584 | A | * | 3/1961 | Snapp | 33/464 |
| 4,697,351 | A | | 10/1987 | Hopfer | 33/420 |
| 4,910,876 | A | * | 3/1990 | Channell | 33/478 |
| 4,920,658 | A | | 5/1990 | Hile | 33/499 |
| 5,020,233 | A | * | 6/1991 | Syken | 33/465 |
| 5,357,683 | A | * | 10/1994 | Trevino | 33/465 |
| 5,669,149 | A | | 9/1997 | Meitzler | 33/471 |
| 5,819,427 | A | | 10/1998 | Rohweder | 33/478 |
| 5,855,076 | A | | 1/1999 | Warner et al. | 33/562 |

* cited by examiner

*Primary Examiner*—Christopher W. Fulton
(74) *Attorney, Agent, or Firm*—James K. Weixel; Leonard Charles Suchyta

(57) ABSTRACT

An expandable tool for laying out and marking predetermined angular layout lines on a work surface. The tool is comprised of a first leg (202), second leg (204), and hypotenuse leg (206) which are assembled by the user such that the intersection of the first and second leg form the desired angle as defined by the hypotenuse (206). The general shape of the assembled tool will normally be a triangle. Each leg of the tool can consist of a single leg portion (or member), or alternatively, each leg can be made up of more than one leg portion. The ends of each leg are fitted with a fastening mechanism (214) for connecting the leg portions together. The tool can be made to various sizes by the addition and deletion of leg portions. Additionally, the tool can be disassembled to facilitate compact transport to subsequent work sites.

7 Claims, 8 Drawing Sheets

EXTENDABLE TOOL FOR USE MARKING ANGULAR LINES

FIELD OF THE INVENTION

The present invention relates generally to laying out reference lines on a work surface and more particularly to establishing lines having predetermined angles.

BACKGROUND OF INVENTION

In the building and remodeling trades there exists the need to efficiently establish accurate reference lines during a given project. Often it is desired that the reference lines be drawn at a predetermined angle with respect to each other. In many situations, it is desired that the lines be drawn perpendicular to one another, i.e. they establish a ninety-degree angle, on the work surface. Ninety degree angles are required for true corners, for marking parallel lines along a common base line, and for establishing walls that are perpendicular to a given supporting surface, e.g. a floor. To be efficient, tradesmen desire a tool which: allows them to quickly and accurately layout lines to a desired angle, can be used by a single person, and is readily portable so that it can be moved from one job site to another easily. In addition, the tool should not be prohibitively expensive because job site tools often need to be replaced because of theft, wear, or accidental damage.

Several economical tools exist that allow a single person to quickly lay out angular lines over a short distance, e.g. less than 3 linear feet. Examples of these tools are framing squares, speed squares, combination squares, and protractors. While these tools are efficient over short distances, a second person and additional tools are required to make layouts over longer distances. For example a long baseline layout of perpendicular lines would be accomplished as shown in FIG. 1. In FIG. 1 a series of equipment racks 104 are to be installed in parallel rows 102 inside a computer room 100 at a fixed spacings 114. In addition, the equipment racks 104 are to be perpendicular to, and spaced away from, wall 120. As can be seen in FIG. 1, a standard framing square 106 is used to establish a perpendicular line to the baseline (wall 120). After framing square 106 is in place, worker 116 holds the framing square 106 in place and then places one end of a chalk line 108 along the edge of the framing square 106 which is perpendicular to wall 120. Next, worker 110 pulls the chalk line 108 out to the desired end point and aligns the chalk string with a perpendicular edge of the framing square with assistance from worker 116. After the chalk line 108 is aligned and pulled taut, worker 110 snaps the chalk line 108 to mark a line on a floor 122. Using two workers to perform the layout shown in FIG. 1 significantly increases the cost of the job over what it would be if a single worker could perform the layout. In addition, the accuracy achieved over long baseline measurements is questionable because a lateral movement of several inches by worker 110 may not result in a perceptible error to worker 116 as they look along the long edge of the framing square 106.

Economical layout tools have been designed to address the portability shortcomings associated with standard layout tools; however, they do nothing to extend the distances over which accurate layouts can be made by a single person. Examples of improved short baseline layout tools can be found in U.S. Pat. No. 5,819,427 which discloses a pull apart carpenter's framing square, U.S. Pat. No. 5,669,149 which discloses a folding framing square and layout tool, and U.S. Pat. No. 4,920,658 which discloses a collapsible framing square.

Thus, a need exists for an extendable layout tool that can be used by one person for establishing angular lines over longer distances. In addition, the tool should reduce in size for easy transport and the tool should not be prohibitively expensive.

SUMMARY OF INVENTION

An object of the present invention is to improve layout tools for establishing angular lines on a work surface. Another object of the invention is to provide a portable layout tool that is expandable for use in a variety of layout tasks. Additionally, the invention reduces in size for easy transport. Still another object of the present invention is to provide a layout tool that allows a single person to make accurate layouts over much longer distances than those possible using prior art tools and techniques, namely marking layout lines over distances longer than the open arm span of the person using the tool.

According to a first embodiment of the invention, an expandable tool for laying out and marking predetermined angular layout lines on a work surface is provided. The tool includes a first leg, second leg, and hypotenuse leg, each of which is assembled by the user such that the intersection of the first and second leg form the desired angle as determined by the hypotenuse leg.

Each leg of the tool consists of either a single leg portion (or member), or the leg can be made up of more than one leg portion. The ends of each leg are fitted with fastening mechanisms that allow the leg portion to be connected to another leg portion, or to another leg.

In an embodiment where each leg is comprised of a single portion, the tool will be realized as follows. The tool includes a first leg, a second leg and a hypotenuse leg. The first leg has a first outer edge, a first proximal end, and a first distal end, and each end has a fastening mechanism associated therewith. The second leg has a second outer edge, second proximal end, and a second distal end, and each end also has a fastening mechanism associated therewith. The hypotenuse leg has a first end and a second end, with each end having a fastening mechanism.

The first proximal end 222 of the first leg 202 couples to the second proximal end 218 of the second leg 204. The first distal end 220 of the first leg 202 couples to a first end 208 of the hypotenuse leg 206. The locations where respective legs join are referred to as intersections. The second proximal end 218 of the second leg 204 is coupled to the first proximal end 222 at one end, and the second distal end 216 is coupled to the second end 210 of the hypotenuse leg 206.

Prior to assembling the tool, the user determines the desired angle for the layout lines. For a given first leg and second leg length, the length of the hypotenuse leg will vary in order to obtain the desired angle. For example, if the desired angle is ninety degrees, the intersection of the outer edges of the first and second legs will form a ninety-degree angle. Using a marking instrument (pencil, crayon, chalk, or the like) a user can mark lines that meet at the desired angle, here ninety degrees.

According to another embodiment, one or more of the legs includes more than one leg portion, each portion of that leg will have a first fastenable end 308, 314 and 322 and a second fastenable end 310, 316 and 320, with each fastenable end having a fastening mechanism 312, 318 and 324 associated with it. For embodiments where a given leg has many leg portions, the innermost portions, i.e. portions that do not connect to another leg of the tool, will connect to additional portions of that given leg using the fastening mechanisms located at their respective first fastenable ends and second fastenable ends. In contrast, the outermost leg portions will connect to another leg using the fastening mechanism located at the proximal or distal end if the leg is a first or second leg, or at the first end or second end if it is the hypotenuse leg. When multiple first or second leg portions are used, and connected together, it is desirable that the outer edges form a straight line to aid in marking layout lines.

Other embodiments of the expandable tool will be described and others will be obvious to the reader without departing from the spirit of the disclosed invention. For example, in another embodiment one can replace the hypotenuse leg with a first and second unit which are located at the distal ends of the first and second legs, respectively. The first and second unit send out communication signals (electromagnetic, optical, sonic, etc.) such that the user is notified when the distance between the first and second unit are such that a desired angle is formed at the intersection location of the first and second legs.

The above embodiments and others will be described in detail below.

DETAILED DESCRIPTION OF INVENTION

The disclosed invention allows a single user to perform the layout of perpendicular lines, or other lines having a predetermined angular relationship, over extended distances without requiring additional tools or assistance. In addition, the invention is expandable so that it can be assembled, or expanded, to a size appropriate for a given layout task. The invention will be described in detail below.

Exemplary Embodiment (single piece leg)

Figure 1:
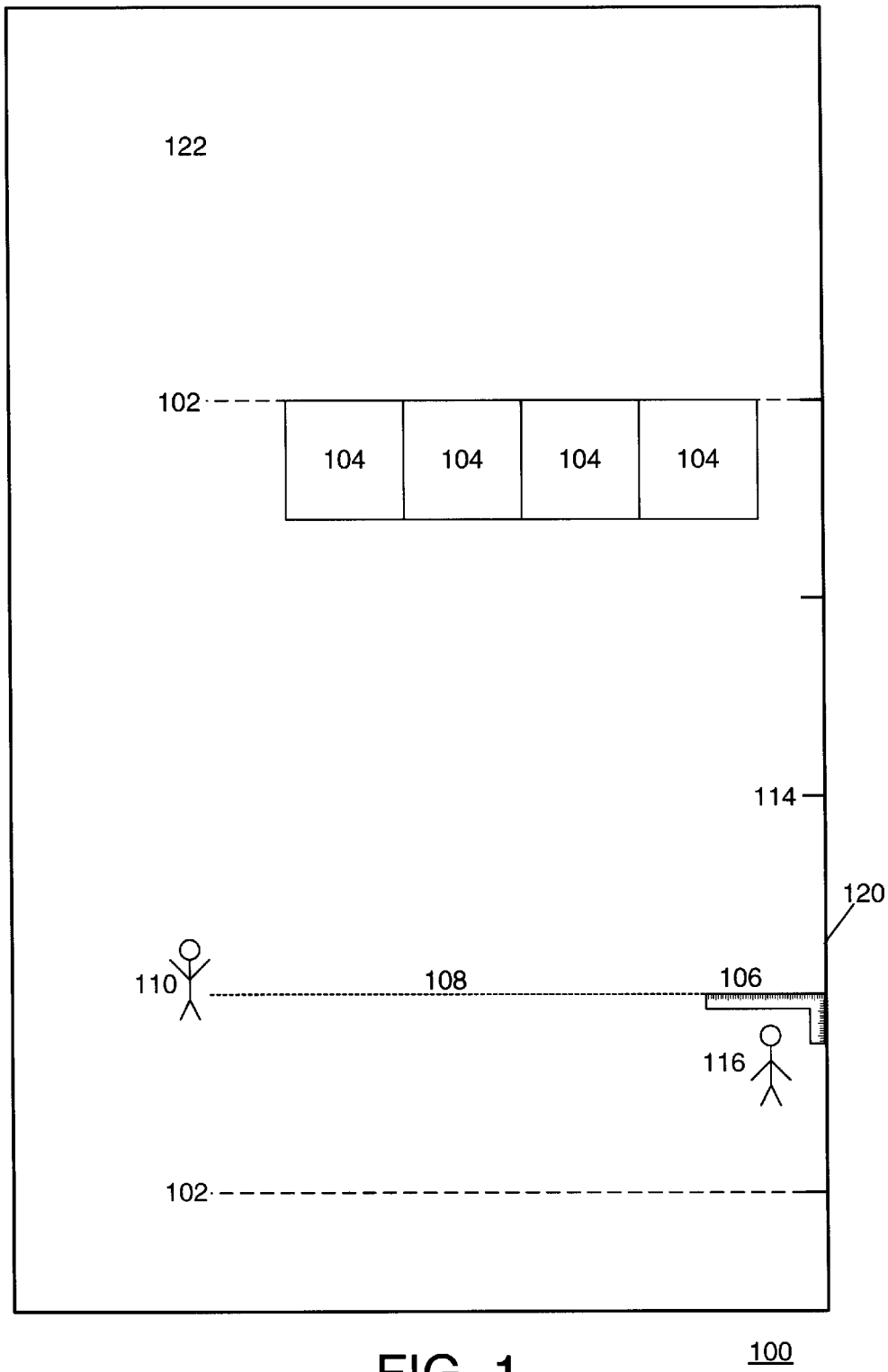
FIG. 1 (PRIOR ART)
FIG. 1—illustrates a prior art method of laying out perpendicular lines for a computer room.
Figure 2:
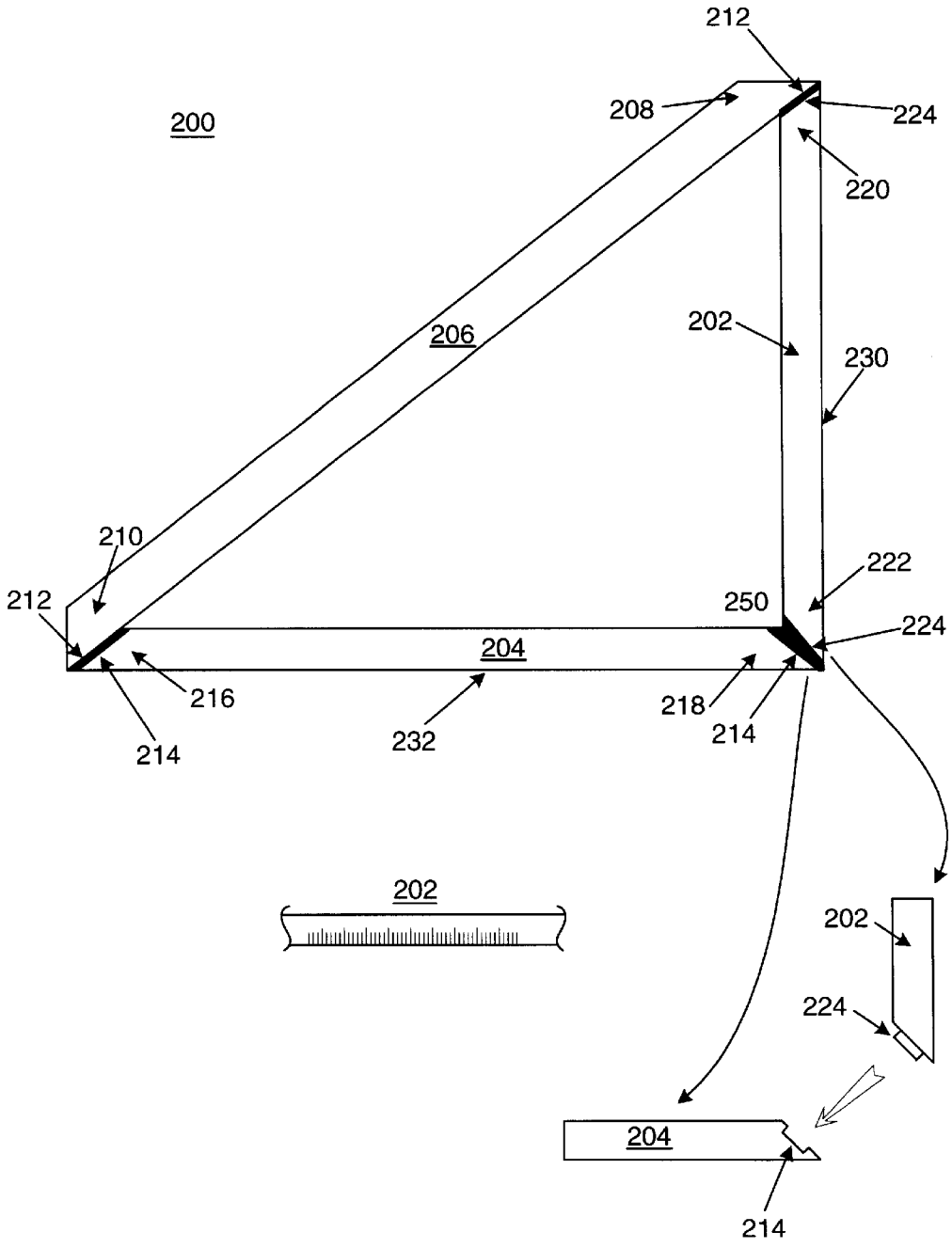
FIG. 2—illustrates a preferred embodiment of the present invention, an expandable tool for marking predetermined angular lines.

An expandable tool for marking predetermined angular layout lines is shown in FIG. 2 as tool 200. The tool 200 is comprised of a first leg 202, a second leg 204 and a hypotenuse leg 206. The first, second, and hypotenuse legs are normally elongate such that coupling points, e.g. fastening mechanism 212, are located at opposite ends of the long axis; however, the first, second and hypotenuse legs can be other shapes. The first leg 202 has a proximal end 222 and a distal end 220. In addition, there is a fastening mechanism 224 located at each proximal and distal end of the first leg 202. The fastening mechanism 224 is integral to the proximal and distal end of the first leg 202. As such, separate fastening mechanisms are not required for connecting leg members together. The first leg 202 also has a first outer edge 230. It is preferable, but not required, that the outer edge 230 be straight and relatively smooth to aid in drawing layout lines using the assembled tool.

The tool 200 also has a second leg 204. The second leg has a proximal end 218, a distal end 216, and an outer edge 232. Also located at each end of the leg 204 is a fastening mechanism 214. As previously noted, the fastening mechanism 214 is normally integral to the proximal and distal ends of the second leg 204. The fastening mechanism 214 is employed to rigidly connect the second leg 204 to adjacent components. The second outer edge 232 is preferably straight and relatively smooth to aid accuracy when performing layout operations. In addition, the intersection of the first and second outer, or outside, edges of the first leg 202 and second leg 204 should form a predetermined angle, in FIG. 2 by way of example, it is a substantially a ninety degree angle 250. To further enhance the usefulness of the tool, marking indicia can be disposed along the face of the legs to facilitate making measurements. The indicia are preferably disposed along the outside edges of the first and second legs 230 and 232, respectively. An example of indicia along the outside edge of the first leg 202 is shown in the bottom portion of FIG. 2.

A hypotenuse leg 206 has a first end 208 and a second end 210. Wherein each end 208 and 206 are adapted for connecting the hypotenuse leg to adjacent like components. When the hypotenuse leg 206 is coupled to the first leg 202 and second leg 204, the outer edges 230, 232 of the first and second leg should form the predetermined angle. For a given length of the first leg and second leg, the length of the hypotenuse leg will be chosen so that the desired angle is achieved. The determination of proper hypotenuse leg length can be done in many ways such as by using a printed legend on one of the legs, lookup tables, a calculator, marking indicia on the first and second legs, etc.

Exemplary Embodiment (multi-piece leg)

Figure 3:
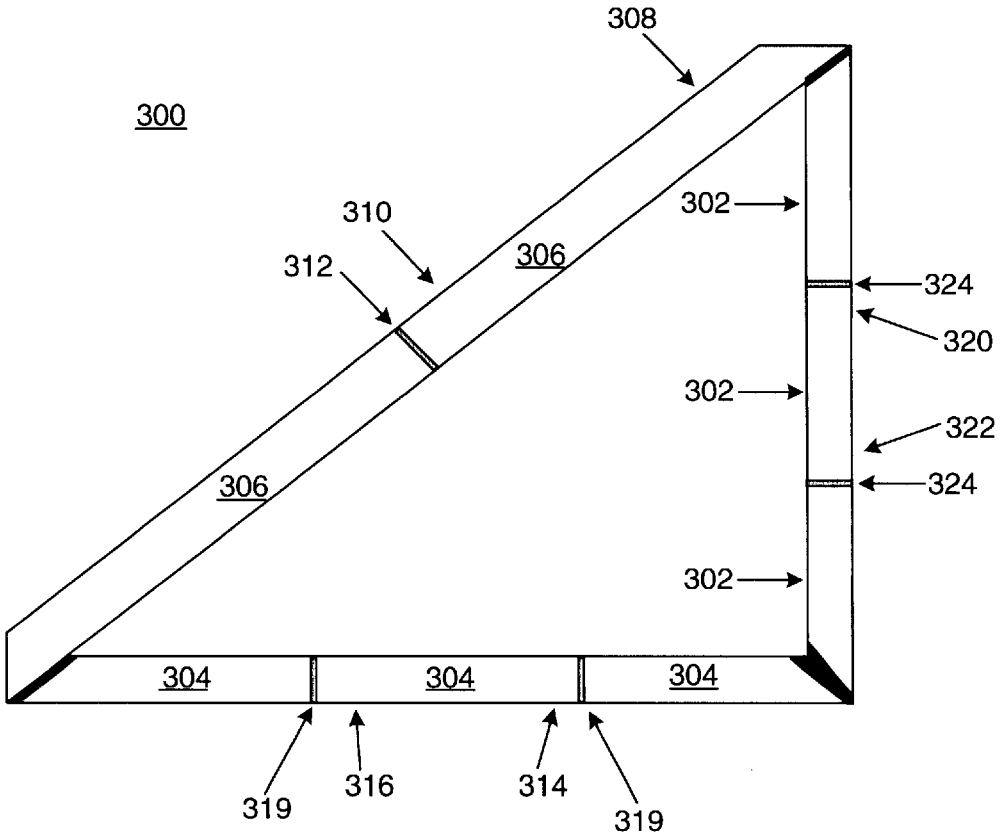
FIG. 3—illustrates an embodiment of the invention wherein each leg is comprised of multiple leg portions.

In another embodiment, the expandable tool for marking predetermined angular lines can have one or more legs comprised of more than one leg portion. Such an embodiment having legs comprised of multiple leg portions is shown in FIG. 3. The expandable tool 300 has a first leg 202, a second leg 204 and a hypotenuse leg 206. In this embodiment, the first, second and hypotenuse leg are each comprised of multiple leg portions. For example the first leg 202 is comprised of a plurality of leg portions 302, the second leg 204 is comprised of leg portions 304, and the hypotenuse leg 206 is comprised of leg portions 306. In addition, each leg portion has a first end 308, 314, 322, and a second end 310, 316, 320, respectively. Furthermore, each end of the respective leg portions has an integral fastening mechanism 312, 319, 324. It is preferable to make all leg portions for a given leg identical so that the individual leg portions can be interchanged without hampering the use of the tool 300; however, leg portions can also be made to varying lengths if desired. In addition, the leg portions 302 and 304 for the first leg 202 and second leg 204 can be interchangeable if desired.

Exemplary Embodiment (modified hypotenuse leg)

Figure 4A:
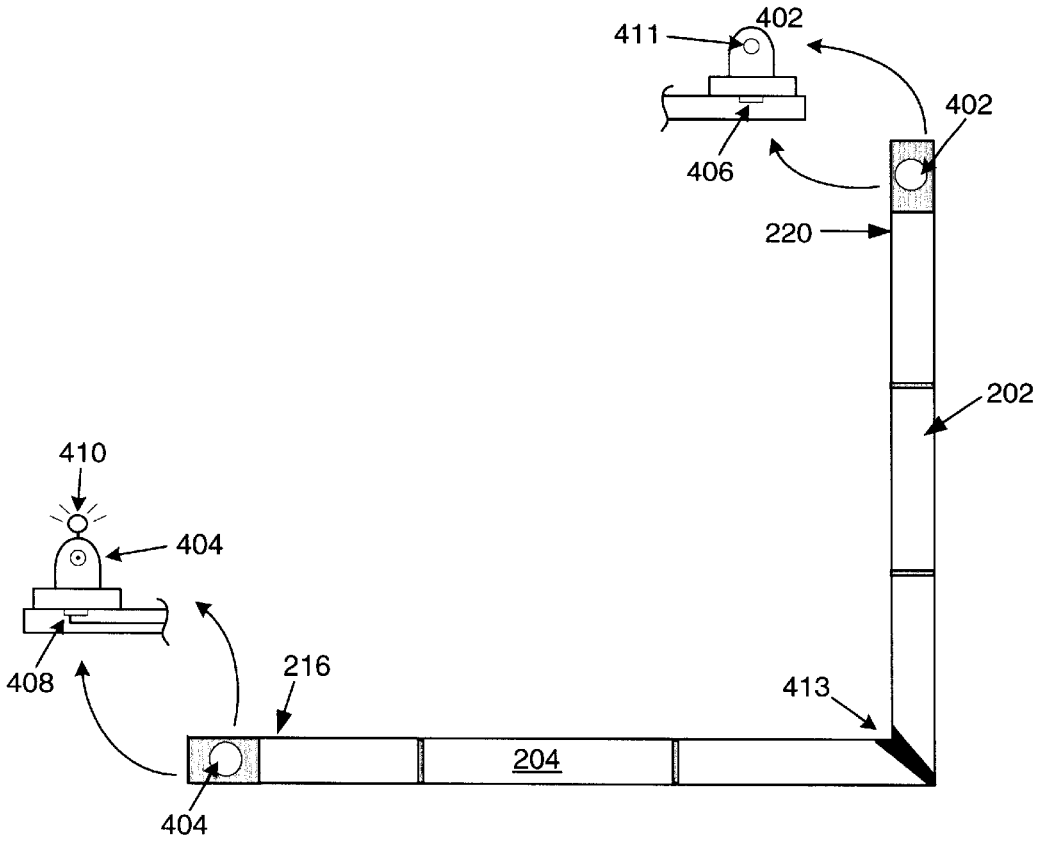
FIGS. 4A–B—illustrates an embodiment of the invention comprising a first and second unit.

In a third embodiment shown in FIG. 4A, the hypotenuse leg is replaced with a first unit 402 and a second unit 404. In a preferred embodiment, the first leg 202 and second leg 204 can be made from a single leg portion or, alternatively, multiple leg portions as shown in FIG. 4. The first unit 402 is mounted on the first distal end 220 of first leg 202 using a first unit fastening mechanism 406, and the second unit 404 is mounted on the second distal end 216 of the second leg 204 using a second unit fastening mechanism 408. Here it is noted that the first and second units 402, 404 can be placed at other locations along the first or second leg; however, in many instances accuracy will deteriorate if the first and second units 402, 404 are placed too close to the intersection of the first and second legs 413. The first and second units 402, 404 are communicatively coupled such that they can determine the necessary hypotenuse length required to achieve a desired angle for a particular first leg 202 and second leg 204 length.

When the distal ends 220, 216 of the first leg 202 and second leg 204 are at the proper hypotenuse spacing, one of the units 402, 404 activates a notification mechanism 410 (here shown as part of unit 404) which notifies the user that the intersection of the first leg and second leg is at the desired angle. The notification mechanism 410 can communicate with the user in several ways well known in the art. For example, an illuminating device can be used to visually notify the user (e.g. LED, strobe light, etc.), an aural device can be used to notify the user (e.g. a speaker, beeping means, etc), a sensation device can be used to notify the user (e.g. a vibrating unit worn by the user), or a processing device can be used to notify the user (e.g. handheld device with a user interface). In addition, many other forms of user notification can be used, including two-way communication, without departing from the spirit of the disclosed invention.

Figure 4B:
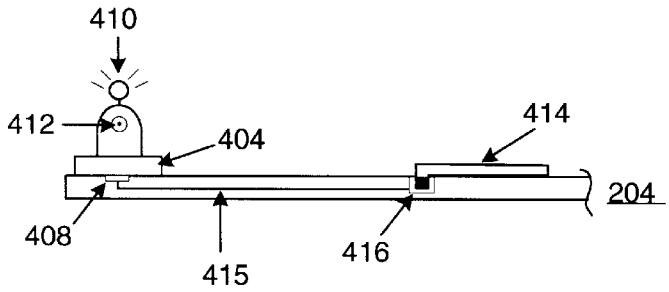

The first unit and second unit fastening apparatus 406 and 408, provide the mechanical connection necessary to keep the first and second units 402, 404 in proper alignment. In addition, the first and second unit fastening apparatus 406, 408 can provide electrical coupling to the first and second units 402, 404 in the event they are driven with an external power source. Whenever a connection performs both a mechanical and electrical function, it is referred to as electromechanical coupling, or alternatively, electromechanical connector. FIG. 4B illustrates the use of an external power source 414 to drive the second unit 404. Although the external power source 414 is shown on the second leg 204, it can be located elsewhere on the tool if desired. The external power source 414 can be of many forms; however, it will normally consist of a battery.

The external power source 414 plugs into a power connection bus 416 that electromechanically couples the power source 414 to the second unit 404 via bus 415. The energy from the power source is used to power the communicating apparatus, here a laser diode 412, which senses proper distance to the first unit 402 comprising a laser reflector 411 (not shown in FIG. 4B) and to power the user notification apparatus 410 (here LED 410).

Exemplary Embodiment (mid-leg hypotenuse coupling)

Figure 5:
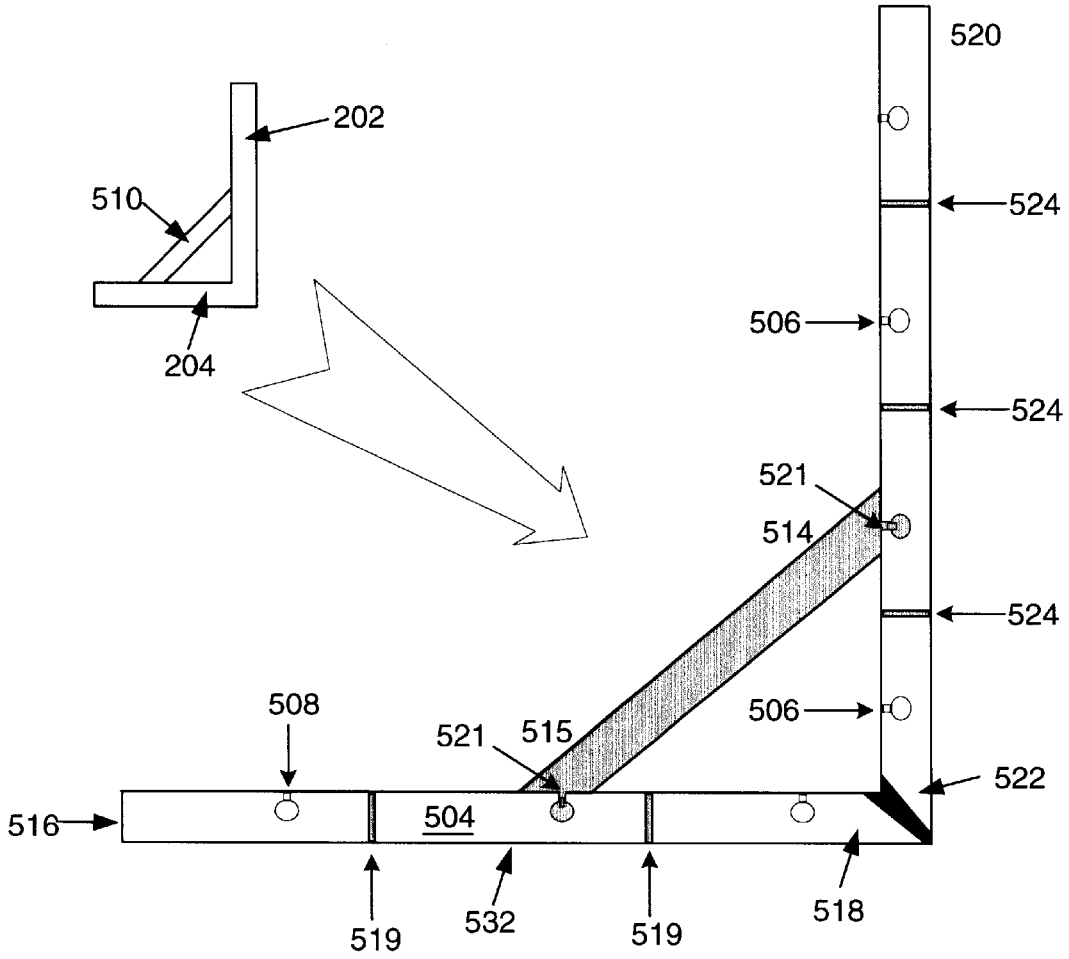
FIG. 5—illustrates an embodiment comprising intermediate fastening mechanism.

Another embodiment of the invention is shown in FIG. 5 in which the hypotenuse leg 510 endpoints 514, 515 are coupled to the first leg 202 and the second leg 204 somewhere between their respective proximal ends 522, 518 and distal ends 520, 516. This configuration is desirable for situations where the hypotenuse configuration of FIG. 2 and FIG. 3 would interfere with obstacles located on the work surface. In this embodiment, the leg portions 502 and 504 are modified to include an intermediate fastening mechanism 506 and 508, respectively. The hypotenuse leg 510 is assembled such that the hypotenuse fastening mechanism 521, located at the first end 514, is coupled to one of the first leg intermediate fastening mechanism 506. The fastening mechanism 521 located at the second end 515 of the hypotenuse leg 510 is coupled to one of the intermediate fastening mechanism 508 located along one of the second leg portions 504. The locations for the intermediate fastening mechanism 506, 508 should be located such that when combined with a given hypotenuse leg length, the outer edges of the first and second legs 530, 532 form the desired angle at their intersection.

Corner Portion

Figure 6:
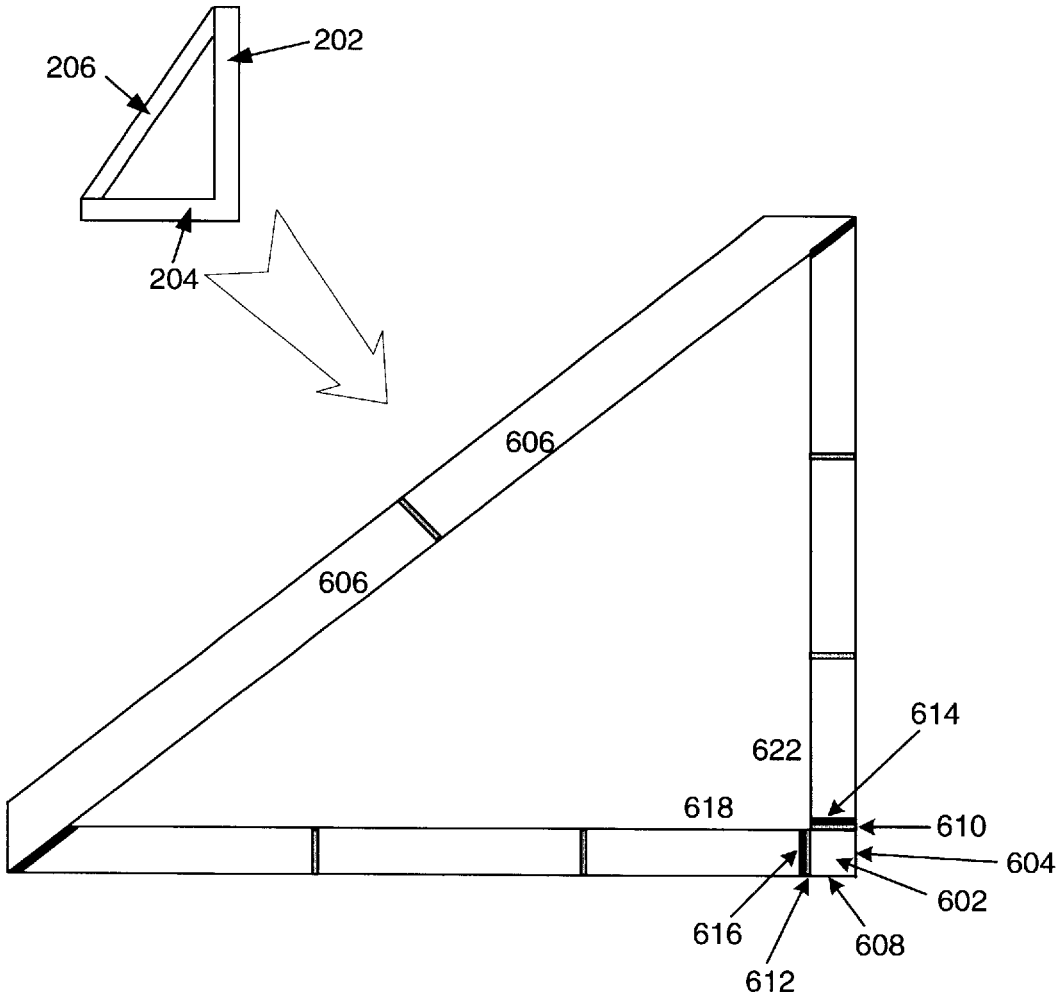
FIG. 6—illustrates an embodiment incorporating a corner portion.
Figure 6:
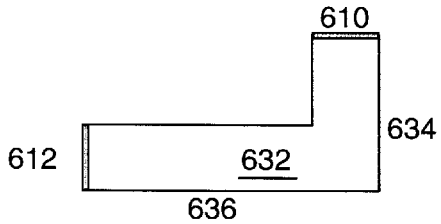

FIG. 6 illustrates a modification to the assembled tool of FIG. 3 comprising a corner portion 602. The corner portion 602 ensures that a predetermined angle is formed at the intersection of the outer, or outside, edges of the first leg 202 and second leg 204. The corner portion 602 is manufactured so that it has a first side 604 and a second side 608. In addition, the corner portion 602 is manufactured so that the intersection of the first side 604 and second side 608 form the predetermined angle, here shown as a ninetydegree angle. Furthermore, the corner portion 602 has a first fastening mechanism 610 for connecting the corner portion 602 to the fastening mechanism 614 located on the proximal end 622 of the first leg. The corner portion also has a second fastening mechanism 612 for coupling the corner portion 602 to the fastening mechanism 616 located on the proximal end 618 of the second leg 204. Normally, the fastening mechanism will be integral to the proximal ends 622, 618 of the first leg 202 and second leg 204. If desired the first and second fastening mechanism 610, 612 can be identical provided that the mating fastening mechanism 614, 616 on the respective legs are manufactured to match. Although shown as a square in the main top portion of FIG. 6, the corner portion can take on other shapes, such as that shown in the lower portion of FIG. 6.

If the corner portion shape is modified as shown in the lower portion of FIG. 6, then first side 634 and second side 636 can be different lengths. Here it is noted that if the tool is originally assembled without a corner portion 602 and then reassembled with a corner portion, the configuration of the hypotenuse leg 206 may have to be modified by adding additional hypotenuse leg portions 606 to ensure that the entire lengths of the outer edges of the first leg and second leg remain at the desired angle.

Exemplary Embodiment Employing Two Hypotenuse Legs

Figure 7:
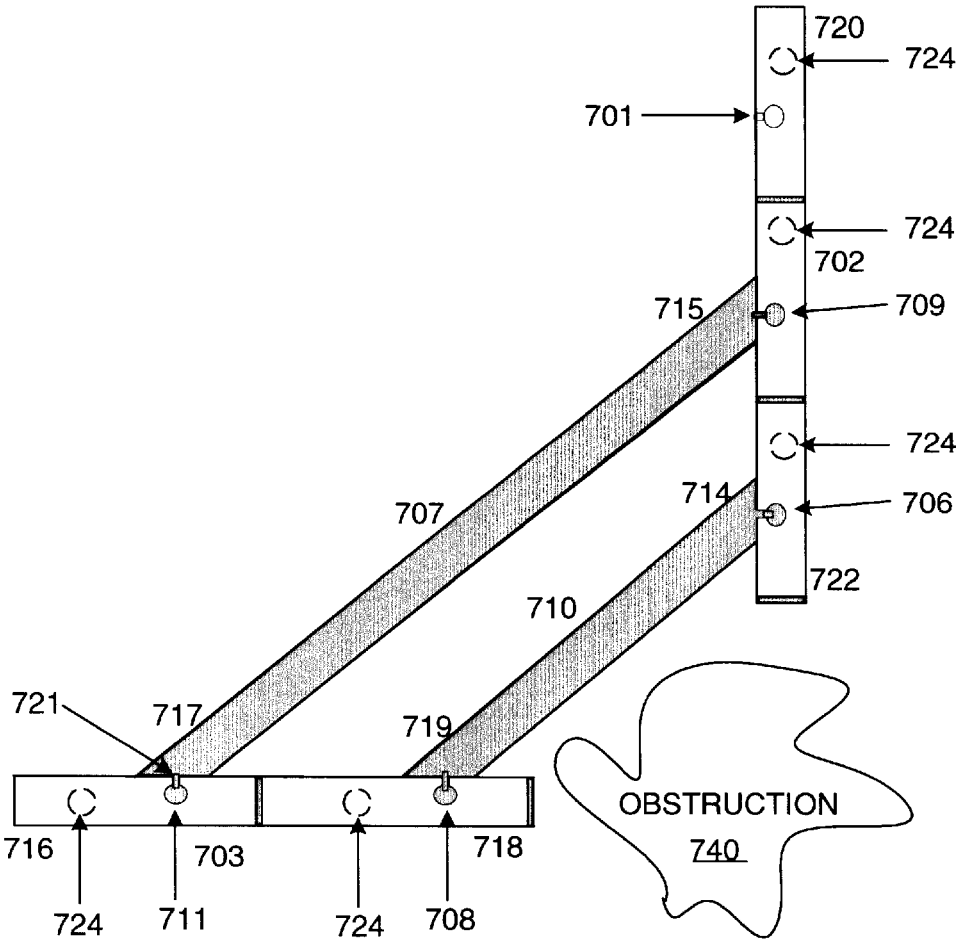
FIG. 7—illustrates an embodiment employing two hypotenuse legs.

At times, a job site obstruction 740 is located such that the first or second leg, of the heretofore mentioned embodiments, cannot be placed in sufficient contact with a surface to facilitate proper use of the tool. The embodiment illustrated in FIG. 7 overcomes this limitation through the use of at least two hypotenuse legs 707, 710. The notable difference in the embodiment of FIG. 7 is that the first leg 702 and second leg 703 do not intersect with each other. Instead, a first hypotenuse leg 710 and a second hypotenuse leg 707 are used to maintain proper angular orientation of the first leg 702 and second leg 703. The two hypotenuse legs 710, 707 each have a first end 714, 715, respectively, and a second end 719, 717, respectively. In addition, each end of the first hypotenuse leg 710 and second hypotenuse leg 707 is equipped with a fastening mechanism 721. The fastening mechanism can be any of the types previously described. The first leg 702, the second leg 703, the first hypotenuse leg 710 and second hypotenuse leg 707 can each be comprised of a single leg portion or they can be assemble from multiple leg portions as previously described.

To use the embodiment illustrated in FIG. 7, the user first determines the desired angle for the layout lines. Next, in the case of legs comprised of multiple leg portions, the user determines the appropriate number of respective leg portions required to obtain an assembled tool with a first leg 702 and second leg 703 in the desired angular relationship. The required number of leg portions can be determined in one of several ways such as by the use of a look-up table, manual calculation, etc. After determining the correct numbers and types of leg portions, the user assembles the leg portions together for each respective leg, in the case of multiple leg portions; otherwise, the user connects the hypotenuse legs 710, 707 to the intermediate fastening mechanisms 706, 709, 708, 711 as follows. Each hypotenuse leg has a first end 714, 715 and a second end 719, 717. The first end 714 of the first hypotenuse leg 710 is connected to the intermediate fastening mechanism 706 located closest to the first proximal end 722 of first leg 702. Next, the second end 719 of the first hypotenuse leg 710 is connected to the intermediate fastening mechanism 708 located closest to the second proximal end 718 of second leg 703. Then, the first end 715 of the second hypotenuse leg 707 is connected to the intermediate fastening mechanism 709 that is the second one in from the first distal end 720 of the first leg 702. Alternatively, first end 715 of the second hypotenuse leg 707 can be attached to the intermediate fastening mechanism 701 if the length of the second hypotenuse leg 707 is adjusted to maintain the proper angular orientation. Finally, the second end 717 of the second hypotenuse leg 707 is connected to the intermediate fastening mechanism 711 located closest to the second distal end 716 of the second leg 703. Upon connecting the second end 717 of the second hypotenuse leg 707 to the second leg 703, the first leg 702 and second leg 703 are in proper alignment to mark the desired angle. Although FIG. 7 illustrates an embodiment with two hypotenuse legs, the tool can be constructed with more than two hypotenuse legs. Additionally, the hypotenuse legs 710, 707 can be replaced with sending units disposed along the first leg 702 and second leg 703 to keep the first leg 702 and second leg 703 aligned at the desired angle.

Fastening Mechanism

The fastening mechanism 312, 318 and 324 (FIG. 3) can be employed in various forms to couple leg portions together. For example the fastening mechanism can be magnetic or mechanical. A magnetic fastening mechanism uses permanent magnets or electromagnets to hold leg portions and assembled legs in proper alignment when using the tool. A mechanical fastening mechanism maintains alignment using structural interconnections. Examples of mechanical fastening mechanisms are spring-loaded catches, hooking mechanisms, friction fits, vacuum fits, and puzzle piece like connections, such as those used in FIG. 7. In addition, both the magnetic and mechanical fastening mechanisms can be enhanced with additional security mechanisms such as retaining pins, retaining catches, locks, etc. Furthermore, the fastening mechanisms can also function as conductors for coupling signals (electrical, optical, acoustical, or the like) from one leg portion to another, or from one leg to another. It is preferable, but not required, to make all interconnecting fastening mechanisms identical for a given leg so that leg portion pieces can be made interchangeable. Whatever fastening mechanism is selected, it should result in an assembled tool that is essentially rigid and straight along the outside of the first and second legs 202, 204, respectively. First and second legs that are rigidly fastened in series result in a tool that is easier to use and more accurate for a majority of applications. Normally, the hypotenuse leg 206 will also be essentially rigid unless the configuration shown in FIG. 4 is employed.

Materials

Leg portions can be made out of a variety of materials such as steel, plastic, highdensity foam, wood, composites, etc. These materials can be conductive, magnetic, electrostatic, fire resistant, self-extinguishing, etc. as desired. Whatever material is selected, it is preferable that it be no thicker than necessary to provide the necessary structural stiffness required to make the assembled tool essentially rigid. In addition, it is desirable to use materials that are stable (i.e. do not change, or minimally change) with respect to moisture, temperature, or other environmental conditions. Furthermore, it is helpful, but not necessary, that the top surface of the tool be flat. A flat top surface results in a tool that is more appealing to the eye, makes marking indicia easier to read, and when disassembled it allows the stacked pieces to occupy less volume. If desired, particular leg portions can be color coded to aid in the assembly of the tool.

The undersides of the legs can be made to temporarily adhere to a given work surface by using an attaching apparatus 724. Having a tool that adheres to the work surface is especially beneficial when performing layouts on vertical work surfaces. Normally, attaching apparatus 724 is intermittently disposed along the length of the legs. In addition, attaching apparatus 724 is recessed into the underside of the legs so that the bottom face of the tool rests flush against the work surface. For most applications, attaching apparatus 724 should not create permanent bonds that cannot be broken without damage to the tool. Examples of acceptable attaching apparatus 724 are magnets (both permanent and electromagnets), mild adhesives, hook-and-loop fasteners, releasable suction cups, and the like.

Exemplary Use of Tool

Figure 8:
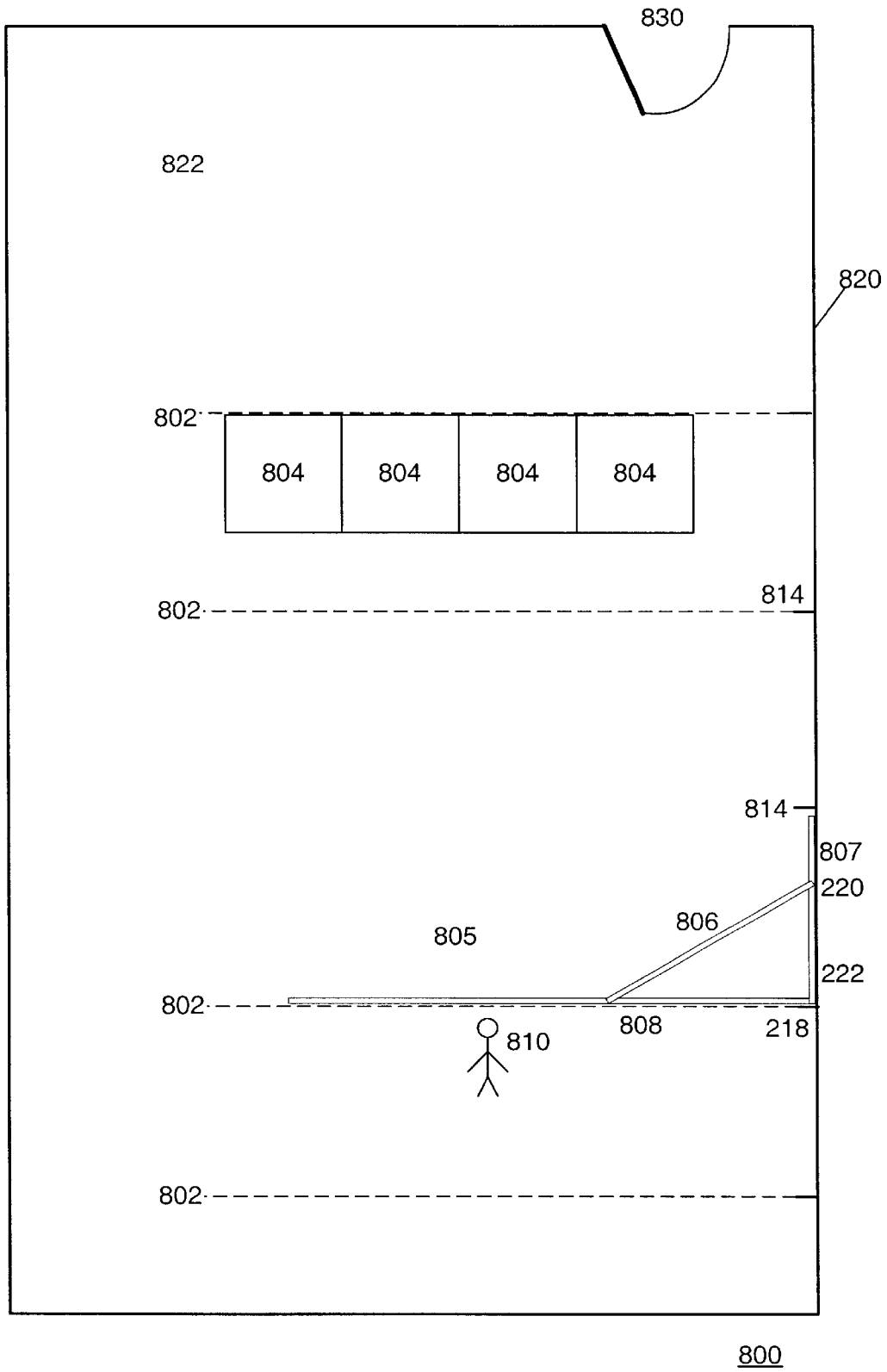
FIG. 8—illustrates a method of using the disclosed invention to layout angular lines.

FIG. 8 provides an illustration of how a tool 805 can be used to perform the layout for an installation of parallel equipment racks 804. Here a computer room 800 has a raised floor 822. Worker 810 desires to install a plurality of equipment racks 804 in parallel rows 802 oriented perpendicular to wall 820. In addition, the racks 804 are to be spaced away from the wall to allow ingress and egress through doorway 830.

Worker 810 begins by assessing the overall layout problem. The assessment will identify the number of lines to be drawn, the desired angles of the lines, the length of layout lines to be marked, and obstacles which may make a particular configuration of the tool 806 more desirable for the job. After making the assessment, worker 810 knows what length to make the tool, and worker 810 also knows the desired angle to be formed by the intersection of the outer edge 230 (not labeled in FIG. 8) of the first leg 807 and the outer edge 232 (not labeled in FIG. 8) of the second leg 808. Next, worker 810 selects the necessary leg member portions 302, 304, 306 (FIG. 3) for the first leg 807, second leg 808 and hypotenuse leg 806, respectively. After selecting the necessary leg portions, worker 810 assembles the tool 805 by connecting the leg portions together for the first leg 807, the second leg 808 and the hypotenuse leg 806, respectively. Then, worker 810 connects the proximal end 222 of the first leg 807 to the proximal end 218 of the second leg 808. Next, the hypotenuse leg 806 is connected to the intermediate fastening mechanism near the distal end 220 of the first leg 807 and the intermediate fastening mechanism of the second leg 810 to form the desired angle.

After assembling the tool 805, worker 810 is ready to perform the layout of angular lines. First, worker 810 determines where the rows 802 will be located along wall 820. Then worker 810 places tool 805 against wall 820 at the desired location points 814. The tool is then made to contact wall 820 along the entire short side 807. Next worker 810 marks a perpendicular line 802 on floor 822. The tool 805 is then moved to the next location and the method is repeated until all layout lines are completed. Next, holes can be drilled (not shown) for mounting the racks. If desired, rack alignment templates such as the one disclosed in U.S. Pat.

No. 5,855,076, layout template for telecommunications switching cabinets, can be used in conjunction with tool 805 to further speed up the installation process.

Although normally unnecessary, it is noted that the disclosed invention can be used with current art layout tools to further extend layout distances and increase the overall usefulness of the layout tool. For example, straight line marking tools such as rulers, levels, chalk lines, and the like, can be used to extend layout lines beyond those possible using only the invention.

SUMMARY

As can be seen, the disclosed invention makes it possible for a single person to accurately and quickly perform the layout of angular lines on a work surface. In addition, the tool is made of readily available materials so that the resulting tool is not unduly expensive. Finally, the tool disassembles for easy and compact transport to the next job site. From the forgoing discussion it will be apparent to the skilled practitioner that variations can be made to the disclosed embodiments and methods without departing from the spirit of the invention.

What is claimed:

1. An expandable tool for marking predetermined angular layout lines, said tool comprising:

an expandable first leg having a proximal end, a distal end, an outer edge, and at least two intermediate fastening mechanisms disposed along the length of the expandable first leg;

an expandable second leg having a proximal end, a distal end, an outer edge, and at least two intermediate fastening mechanisms disposed along the length of the expandable second leg;

a first hypotenuse leg having a first end fastenable to an intermediate fastening mechanism proximate to the proximal end of the expandable first leg, and a second end fastenable to an intermediate fastening mechanism proximate to the proximal end of the second leg;

a second hypotenuse leg having a first end fastenable to an intermediate fastening mechanism proximate to the distal end of the expandable first leg, and a second end fastenable to an intermediate fastening mechanism proximate to the distal end of the expandable second leg; and the expandable tool having the outer edge on the expandable first leg and the outer edge on the expandable second leg oriented for making the predetermined angular layout lines, the expandable tool further having the expandable first leg and the expandable second leg displaced by a distance sufficient for allowing the tool to mark the layout lines in the presence of an obstruction.

2. The expandable tool according to claim 1 wherein said expandable first leg further comprises:

a first portion having a first fastenable end and second fastenable end; and a second portion having a first fastenable end and second fastenable end, rigidly fastenable in series with one of the first or second fastenable ends of the first leg first portion.

3. The expandable tool according to claim 1 wherein said expandable second leg further comprises:

a first portion having a first fastenable end and second fastenable end; and a second portion having a first fastenable end and second fastenable end, rigidly fastenable in series with the first fastenable end of the second leg first portion.

4. The expandable tool according to claim 2 or 3 wherein the first fastenable end and second fastenable end of a leg portion provide electromechanical coupling to adjacent leg portions.

5. The expandable tool according to claim 1 wherein the expandable first leg at least has attaching apparatus disposed along its length for removably attaching the expandable tool to a work surface.

6. The expandable tool according to claim 1, further comprising marking indicia disposed along at least one of the expandable first leg, expandable second leg, or expandable hypotenuse leg.

7. The expandable tool according to claim 1, having a power connection on at least one of the expandable first leg, expandable second leg, first hypotenuse leg, or second hypotenuse leg.

* * * * *